US011156034B2

(12) United States Patent
Ayub

(10) Patent No.: US 11,156,034 B2
(45) Date of Patent: Oct. 26, 2021

(54) NOTCHING A WELLBORE WHILE DRILLING

(71) Applicant: Saudi Arabian Oil Company, Dhahran (SA)

(72) Inventor: Muhammad Ayub, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 15/463,552

(22) Filed: Mar. 20, 2017

(65) Prior Publication Data

US 2018/0266183 A1 Sep. 20, 2018

(51) Int. Cl.

| | |
|---|---|
| ***E21B 7/28*** | (2006.01) |
| ***E21B 7/18*** | (2006.01) |
| ***E21B 7/14*** | (2006.01) |
| ***E21B 43/26*** | (2006.01) |
| ***E21B 10/32*** | (2006.01) |
| ***E21B 43/24*** | (2006.01) |

(52) U.S. Cl.

CPC ..... *E21B 7/28* (2013.01); *E21B 7/14* (2013.01); *E21B 7/18* (2013.01); *E21B 10/32* (2013.01); *E21B 43/2405* (2013.01); *E21B 43/26* (2013.01)

(58) Field of Classification Search

CPC ..... E21B 7/18; E21B 7/28; E21B 7/14; E21B 10/32; E21B 43/2405; E21B 43/26

See application file for complete search history.

(56) References Cited

U.S. PATENT DOCUMENTS

| | | | | |
|---|---|---|---|---|
| 2,307,658 A * | 1/1943 | Appleby | ..... | E21B 7/18 175/242 |
| 3,211,221 A | 10/1965 | Huitt | | |
| 3,303,883 A | 2/1967 | Slusser | | |
| 3,313,348 A | 4/1967 | Huitt et al. | | |
| 4,339,008 A | 7/1982 | Ford et al. | | |
| 4,974,675 A | 12/1990 | Austin et al. | | |
| 5,363,927 A * | 11/1994 | Frank | ..... | E21B 7/18 166/223 |

(Continued)

FOREIGN PATENT DOCUMENTS

| | | |
|---|---|---|
| CN | 102137981 | 7/2011 |
| CN | 104121004 | 10/2014 |

(Continued)

OTHER PUBLICATIONS

"Flo-Activated Tubing Cutter," Limar Oil Tools, 2 pages, <https://www.limaroiltools.com/coiled-tubing/flo-activated-tubing-cutter>.

(Continued)

*Primary Examiner* — Dany E Akakpo
(74) *Attorney, Agent, or Firm* — Fish & Richardson P.C.

(57) ABSTRACT

A wellbore is drilled in a formation using a drill string assembly that includes a drill string. A drill bit is connected to a downhole end of the drill string. A notching tool is connected to the drill string. After drilling the wellbore to a depth from a surface in the formation, the drilling is paused. The notching tool is rotated. a notch is formed with the rotating notching tool. In subsequent operations, DSA is removed from the well and the fracturing fluid pumped from the surface can create fractures at the locations of notches. These fractures would improve wellbore connectivity with the reservoir for better oil and gas recovery.

6 Claims, 11 Drawing Sheets

(56) References Cited

U.S. PATENT DOCUMENTS

| | | | | |
|---|---|---|---|---|
| 5,472,049 | A | 12/1995 | Chaffee et al. | |
| 5,662,170 | A | 9/1997 | Donovan et al. | |
| 5,735,359 | A | 4/1998 | Lee et al. | |
| 5,944,105 | A * | 8/1999 | Nguyen | E21B 43/025 166/278 |
| 7,490,664 | B2 | 2/2009 | Skinner et al. | |
| 7,503,404 | B2 | 3/2009 | McDaniel et al. | |
| 9,995,126 | B1 * | 6/2018 | Hice | E21B 7/18 |
| 2004/0244970 | A1 * | 12/2004 | Smith, Jr. | E21B 7/14 166/250.01 |
| 2005/0230107 | A1 | 10/2005 | McDaniel et al. | |
| 2006/0191684 | A1 | 8/2006 | Smith, Jr. | |
| 2009/0151938 | A1 * | 6/2009 | Conkle | E21B 43/26 166/254.1 |
| 2010/0089583 | A1 * | 4/2010 | Xu | E21B 10/322 166/298 |
| 2010/0243242 | A1 | 9/2010 | Boney et al. | |
| 2010/0326659 | A1 | 12/2010 | Schultz et al. | |
| 2012/0298422 | A1 | 11/2012 | Oxford | |
| 2013/0008653 | A1 | 1/2013 | Schultz et al. | |
| 2014/0360778 | A1 | 12/2014 | Batarseh | |
| 2016/0201440 | A1 * | 7/2016 | Aidagulov | E21B 43/26 166/285 |
| 2017/0306703 | A1 * | 10/2017 | Samuel | E21B 49/003 |

FOREIGN PATENT DOCUMENTS

| | | |
|---|---|---|
| CN | 104696003 | 6/2015 |
| WO | WO 2010074980 | 7/2010 |
| WO | WO 2016085490 | 6/2016 |
| WO | 2016186690 | 11/2016 |

OTHER PUBLICATIONS

Batarseh et al, "Innovation in Wellbore Perforation Using High-Power Lawer," International Petroleum Technology Conference (IPTC 10981), Doha, Qatar, Nov. 21-23, 2005; 7 pages.

Batarseh et al., "High Power Laser Application in Openhole Multiple Fracturing with an Overview of Laser Research; Past, Present and Future," Society of Petroleum Engineers (SPE 160836), SPE Saudi Arabia Section Technical Symposium and Exhibition, Al-Khobar, Saudi Arabia, Apr. 8-11, 2012; 10 pages.

Batarseh et al., "Well Perforation Using High-Power Lasers," Society of Petroleum Engineers (SPE 84418), SPE Annual Technical Conference and Exhibition, Denver, CO, Oct. 5-8, 2003; 10 pages.

Besson et al., "On the Cutting Edge," Oilfield Review, vol. 12, No. 3, published 2000; pp. 36-57.

Dardis et al., "Degradable Alternative to Risky Mill-Out Operations in Plug and Perf," Society of Petroleum Engineers (SPE-173695-MS), SPE/ICoTA Coiled Tubing and Well Intervention Conference and Exhibition, Woodlands, TX, Mar. 24-25, 2015; 10 pages.

Gandossi, "An Overview of Hydraulic Fracturing and other Formation Stimulation Technologies for Shale Gas Production," JRC Technical Reports, Joint Research Center, Report EUR 26347 EN, published 2013; 64 pages.

Huitt et al., "Mechanical Tool for Preparing a Well Bore for Hydraulic Fracturing," Drilling and Production Practice, American Petroleum Institute, published 1960; pp. 129-133.

Keshavarzi, "Laser Perforation for Hydraulic Fracturing in Oil and Gas Wells," Americal Rock Mechanics Association (ARMA 11-115), 45th US Rock Mechanics / Geomechanics Symposium, San Francisco, CA, Jun. 26-29, 2011; 5 pages.

Kritsanaphak et al., "Using Hydrajet Perforating Technique as an Effective Alternative to Explosive Perforating for Algerian Oil and Gas Fields," IADC/SPE Asia Pacific Drilling Technology Conference and Exhibition (IADC/SPE 136066), Ho Chi Minh City, Vietnam, Nov. 1-3, 2010; 14 pages.

Marya et al., "Application and Benefits of Degradable Technology in Open-Hole Fracturing," SPE Annual Technical Conference and Exhibition (SPE 166528), New Orleans, LA, Sep. 30-Oct. 2, 2013; 9 pages.

Pooniwala, "Lasers: The Next Bit," SPE Eastern Regional Meeting (SPE 104223), Canton, Ohio, Oct. 11-13, 2006; 10 pages.

Strain, "Well-Bore Notching and Hydraulic Fracturing," Journal of Canadian Petroleum Technology, vol. 1, No. 4, Dec. 1962; pp. 153-161.

Surjaatmadja et al., "Recent Advancements in Hydrajet Perforating and Stimulation Provide Better Penetration and Improved Stimulation," SPE European Formation Damage Conference (SPE 144121), Noordwijk, The Netherlands, Jun. 7-10, 2011; 17 pages.

International Search Report and Written Opinion issued in International Application No. PCT/US2018/023293 dated Jun. 5, 2018, 18 pages.

Gulf Cooperation Council Examination Report issued in GCC Application No. GC2018-34985 dated Oct. 24, 2019, 4 pages.

GCC Examination Report issued in Gulf Cooperation Council Application No. GC2018-34985 dated Aug. 30, 2020, 4 pages.

CN Office Action in Chinese Appln. No. CN 201880033222.X, dated May 7, 2021, with English Translation, 30 pages.

GCC Examination Report issued in Gulf Cooperation Council Application No. GC2018-34985, dated Feb. 28, 2021, 3 pages.

* cited by examiner

NOTCHING A WELLBORE WHILE DRILLING

TECHNICAL FIELD

This disclosure relates to wellbore drilling and fracturing.

BACKGROUND

To improve productivity of oil and gas wells, hydraulic fracturing is used to enhance connectivity between hydrocarbon-bearing reservoir formations and wellbores. In many cases, in tight formations without fractures, flow of hydrocarbons from reservoir formations towards wellbores is difficult to achieve and sustain at required levels. Such formations often include tight sandstones, tight carbonates, and shale. Hydraulic fractures can be created in vertical and horizontal wells both in cased-perforated and open-hole well completions. In cased and perforated wells, because of prior knowledge of perforation locations, initiation, placement, and orientation of fractures can be achieved accurately. However, for open-hole well completions, fractures initiation, accurate placement, and orientation of the fractures involve special operations prior to fracturing. Open-hole well completions, and subsequent hydraulic fracturing, are used in various oil and gas fields. For such open-hole well completions, the current techniques and technologies do not address the issue of accurate placement, orientation, and initiation of fractures in an economically viable manner.

SUMMARY

This disclosure describes technologies relating to notching a wellbore while drilling.

Certain aspects of the subject matter described within this disclosure can be implemented as a method. A wellbore is drilled in a formation using a drill string assembly that includes a drill bit connected to a downhole end of a drill string. A notching tool is connected to the drill string. After drilling the wellbore to a depth from a surface in the formation, the drilling is paused. The notching tool is rotated. A notch is formed with the rotating notching tool.

Forming the notch with the rotating notching tool can include activating the notching tool to form the notch. The notching tool is de-activated after forming the notch. Drilling the wellbore in the formation is continued. The notch can be a first notch. The wellbore can be drilled to a second depth from the surface. After drilling the wellbore to the second depth from the surface, the drilling can be paused. The notching tool can be rotated, and a second notch can be formed with the rotating notching tool. The notch can be formed at a notching depth from the surface. The notch can surround the drill string at the notching depth. The notch can be a single, continuous notch spanning the entire circumference of the wellbore at the notching depth. The notching tool can be disengaged from the wellbore during drilling the wellbore to the depth, and the notching tool can be engaged to the wellbore after pausing the drilling.

The notching tool can include a mechanical notching tool, and the notch is formed with the mechanical notching tool. The mechanical notching tool can be activated to extend cutters on an outer circumference of the mechanical notching tool into the wellbore. The cutters can form the notch in the wellbore. The notching tool can further include a hydraulic notching tool. The notch can be formed with the hydraulic notching tool. A hydraulic nozzle can be activated on an outer circumference of the hydraulic notching tool to spray notching fluid on the wellbore. The notching fluid can form the notch in the wellbore.

Activating the mechanical notching tool can include dropping a dissolvable ball into the drill string. The dissolvable ball can be dissolved by the drilling fluid. The dissolvable ball can be received by the notching tool. A hydraulic power is diverted from the drill bit to the mechanical notching tool in response to the notching tool receiving the dissolvable ball. The dissolvable ball is designed to dissolve in the drilling fluid after the notch is formed in the wellbore.

The notching tool can be a laser notching tool. A laser on an outer circumference of the laser notching tool can be activated to direct a laser beam on the wellbore. The laser beam can form the notch in the wellbore. The laser notching tool can be positioned within the drill bit. The laser beam can be transmitted in a direction substantially parallel to a longitudinal axis of the drill string. The laser beam can be diverted in a direction substantially perpendicular to the longitudinal axis of the drill string toward the wellbore. A fiber optic cable extending from the surface to the laser notching tool can be attached. The laser beam can be directed through the fiber optic cable. The notching tool can be a thermal notching tool. The notch can be formed with the thermal notching tool by heating the wellbore to form the notch.

Certain aspects of the subject matter described within this disclosure can be implemented as a method. A drill string assembly is formed. A drill bit is attached to a downhole end of a drill string. A notching tool is attached to the drill string. A wellbore is drilled in a formation using the drill string assembly. After drilling the wellbore to a depth from a surface in the formation, the drilling is paused. The notching tool is at a notching depth from the surface. The notching tool is activated. The activated notching tool is rotated. A notch is formed with the rotating notching tool at the notching depth. The notch surrounds the drill string at the notching depth.

The notching tool can include a hydraulic notching tool. A hydraulic nozzle is activated on an outer circumference of the hydraulic notching tool to spray notching fluid on the wellbore. The notching fluid can form the notch in the wellbore. The notching tool can further include a mechanical notching tool. The mechanical notching tool can be activated to extend cutters on an outer circumference of the mechanical notching tool into the wellbore. The cutters can form the notch in the wellbore. The notching tool can be a laser notching tool that can generate a laser beam. The notch can be formed with the laser notching tool. The laser beam can be transmitted in a direction substantially parallel to a longitudinal axis of the drill string. The laser beam can be diverted in a direction substantially perpendicular to the longitudinal axis of the drill string toward the wellbore. The laser beam can form the notch in the wellbore.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
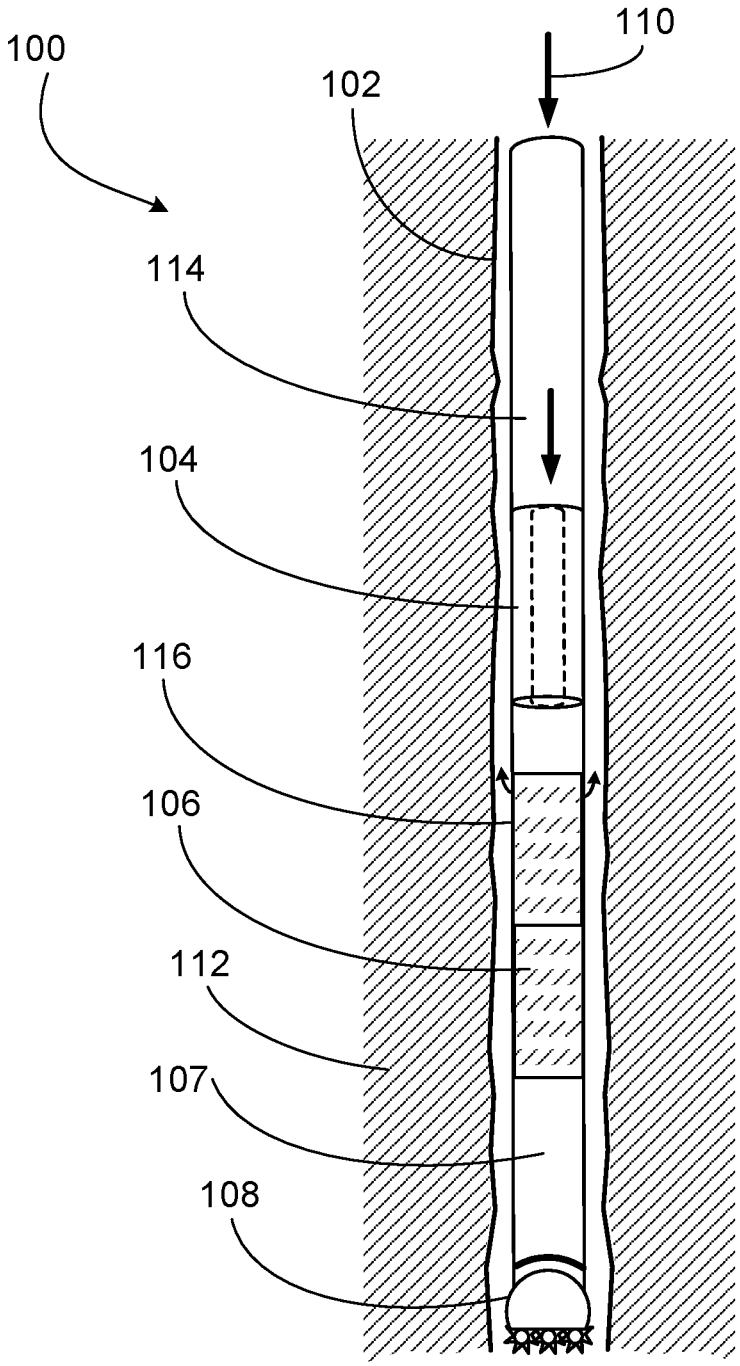
FIG. 1 is a schematic diagram of an example drill string assembly to notch a wellbore while drilling.

In open-hole fracturing operations, the fracturing fluid is pumped or "bullheaded" at high-pressures in a long isolated section of a wellbore. The reservoir formation break apart at relatively weaker (or softer) locations or locations randomly once the pumping pressure exceeds the strength of the rock. When using this technique, fractures may not consistently be created at the desired locations. Rather, the rock can fracture at weaker spots which may not be suitable or ideal to improve hydrocarbon recovery. Creating a notch or notches allows pumping pressure to concentrate at pre-determined points which helps in proper placement of fractures.

In some implementations, the notch can be a v-shaped groove, which, when exposed to high fracture pressure, can extend deeper in the reservoir, and perpendicular to the wellbore. Propagation of the fracture in a direction perpendicular to the wellbore will avoid propagation along the wellbore trajectory. Similarly, holes created with the help of, for example, hydraulic jets or a laser tool, can be directed in any direction relative to, for example, perpendicular to, the wellbore, to control the fracture orientation during a subsequent hydraulic fracturing operation.

Fracture initiation pressure is always much higher than the fracture propagation pressure. As mentioned earlier, high pressure is concentrated at the wedge of "V" notch. The pressure concentration significantly reduces the pumping pressure required to initiate a typical fracture. The depth of the notch into the formation can range from 1-10 feet.

In some open-hole fracture applications, notches are created as a separate operation conducted after drilling and before pumping the fracturing fluids in wells. That is, after completing the drilling operation, the drill string and the drilling tool are retrieved from the wellbore, and a notching tool is lowered into the wellbore to create notches at pre-determined depths from the surface. This disclosure describes well tools that can create notches at pre-determined depths along the open-hole section of the productive formation during the drilling operation. The ability to notch while drilling, that is, perform notching operations during drilling without retrieving the drill string and the drilling tool from the wellbore, can save time, money, and overall operational efficiency.

The notching tools disclosed in this specification are installed on a drill string assembly (DSA), preferably close to the drilling bit. As described later, the disclosed notching tools can be implemented as hydraulic jets, laser-based cutting tools, thermal notching tools, mechanical cutters, or a combination of any implementation previously listed. The notches are created while drilling the wellbore using the DSA, without removing the DSA from the wellbore. After the notches are created, during the well drilling process, and after completion of the drilling operations, the DSA can be pulled out from the completed wellbore in which the notches have been created. That is, the notching operation could be performed with the same DSA as drilling operations effectively allowing notching while drilling (NWD). Subsequently, the wellbore can be hydraulically fractured, particularly at the created notches, using fracturing fluid, and proppant can be used to further propagate and prop the fracture network around wellbores.

FIG. 1 shows an example of a DSA 100 to notch a wellbore 102 while drilling the wellbore 102 into a formation 112 without removing the DSA 100 from the wellbore 102. The DSA 100 includes a drill string 114, a notching tool 104, and a drill bit 108. The drill bit 108 is attached to the downhole end of drill string 114. The notching tool is attached to the drill string 114 uphole to the drill bit 108, as shown in FIG. 1. In some implementations, the DSA 100 can include either a mud motor 107, a drill collar 106, or both. The mud motor 107 is used more often for highly deviated and horizontal wells to increase the rate of penetration while the drill collar 106 is typically used in vertical wellbores to increase weight on the drill bit 108. In some implementations, the DAS 100 can include a logging while drilling tool 116 that can record information about the geologic formation 112 and the wellbore 102 during drilling operations.

As the DSA 100 includes an active drill string 114, drilling fluid 110 flows down the drill string and into the formation to lubricate and cool the bit. The drilling fluid also carries cutting, small pieces of the formation 112 removed by the drill bit 108, to the surface. In certain implementations, the drilling fluid 110 can be used to hydraulically power the notching tool 104. In some implementations, the notching tool can be powered by electrical power, rotation from a mud motor, or rotation from a rotary table.

In order to drill the wellbore 102 with DSA 100, the individual components are assembled (drill bit 108, drill string 114, notching tool 104, and any other components needed for the specific wellbore) with the drill bit 108 located at the downhole end of the drill string 114. The DSA 100 is then rotated as it is extended into the wellbore 102 while drilling fluid 110 is circulated. Once a target depth has been reached, the drilling is paused, that is, the rate of penetration is effectively zero. At the target depth after the drilling is paused, the notching tool 104 is activated. In some implementations, the notching tool 104 requires rotation. The required rotation can be provided by the drill string 114, by a mud motor that is integrated into the notching tool 104, both, or other methods. Once the notching operation is complete, the notching tool 104 is deactivated, and drilling operations can resume. Multiple notches can be formed in the wellbore 102 at various target depths.

A "notch" is a continuous groove or channel cut into the wellbore so that it is circumferentially continuous around the wellbore. The circumferentially continuous nature of the notch makes it distinct from other operations that yield multiple holes extending radially from a wellbore in a star pattern. The notch has a substantially "V" shaped cross section. The tip of the "V" provides a stress concentration factor that allows for more effective fracturing during later fracturing jobs. The notch can extend several feet into the formation.

Figure 2A:
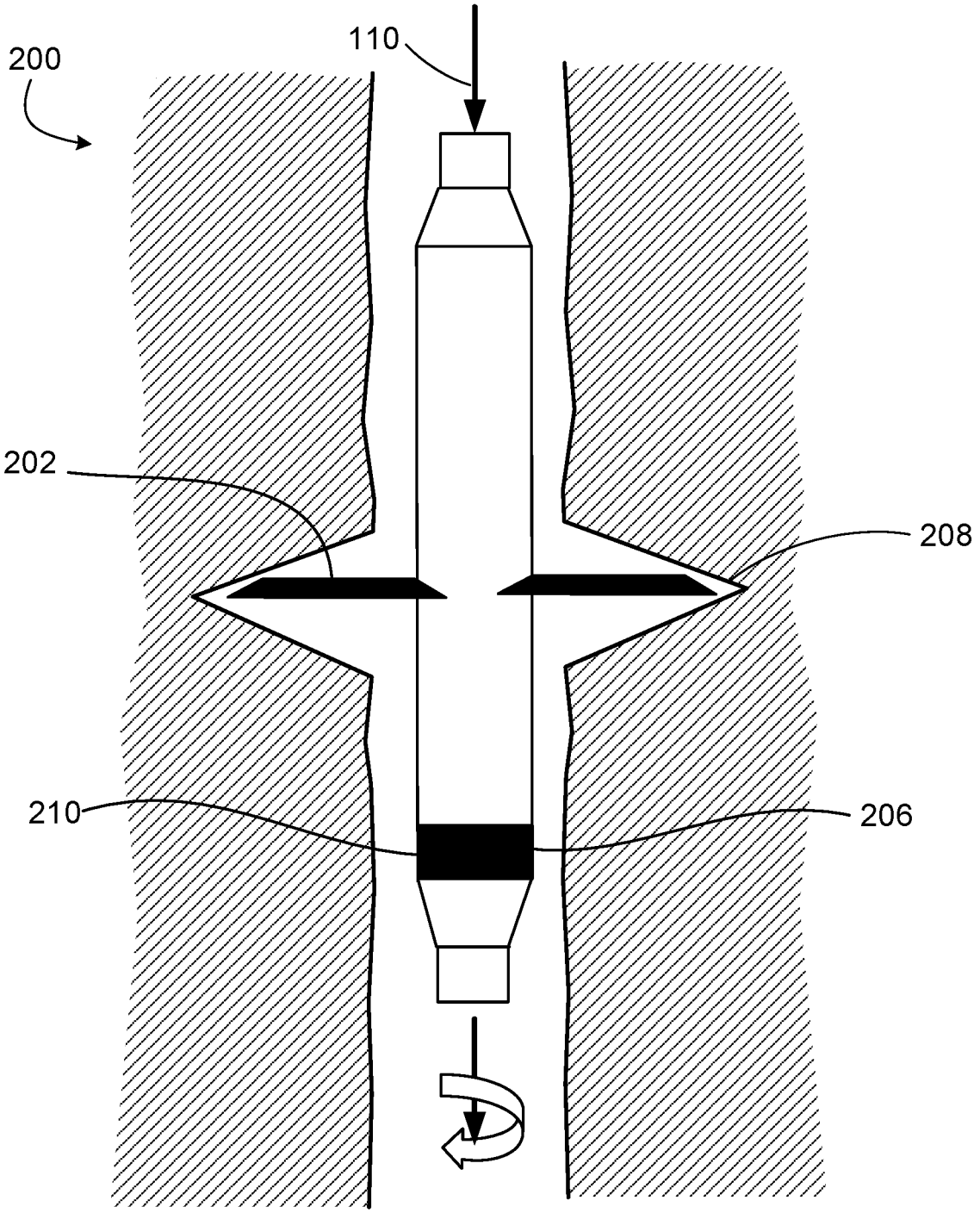
FIG. 2A is a schematic diagram of an example apparatus to mechanically notch a wellbore.

FIG. 2A shows a mechanical notching tool 200 that can be utilized with the DSA 100. The mechanical notching tool 200 can act as the notching tool 104 in some implementations. The mechanical notching tool 200 includes a cutter 202 and a trigger mechanism 210. Mechanical notching tool 200 can be attached to the drill string 114 uphole of the drill bit 108.

In some implementations, a mud motor 206 can be connected to the mechanical notching tool 200. The mud motor 206 is configured to rotate the mechanical notching tool 200 separately from the drill string. The mud motor 206 is powered by drilling fluid 110 flowing through the mechanical notching tool 200. If the mud motor 206 is not included, then the rotation of the drill string may be used to rotate the mechanical notching tool 200.

Figure 2B:
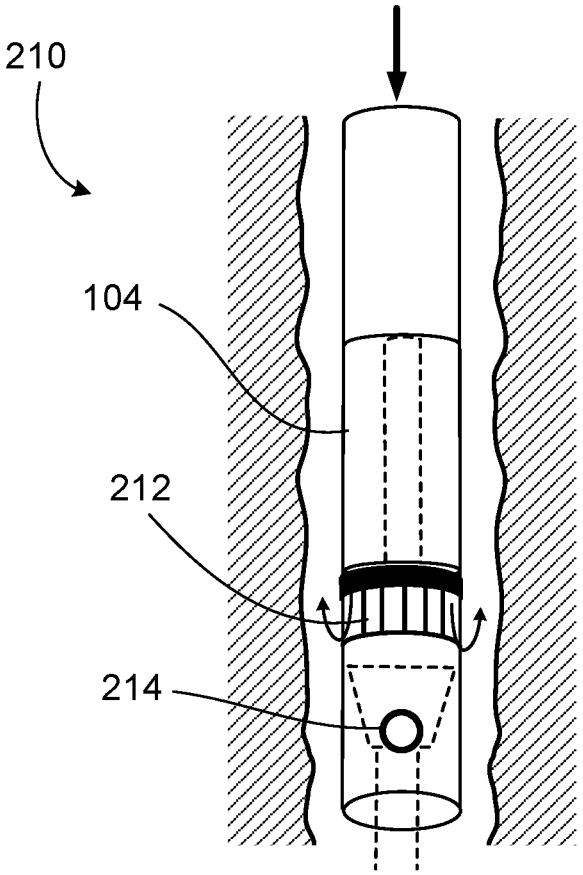
FIG. 2B is a schematic diagram of an example triggering mechanism using a dissolvable ball.

The mechanical notching tool 200 includes a trigger mechanism 210 (shown in greater detail in FIG. 2B) that can be activated by several methods, for example, a ball dropped to a sleeve, a dissolvable ball 214, a hydraulic signal, an electrical signal, radio frequency identification (RFID), or combinations of them. The dissolvable ball implementation illustrated in FIG. 2B works by redirecting the hydraulic power of the drill fluid from the drill bit 108 and towards the notching tool 104. The drill fluid can flow out of the hydraulic vent 212 after passing through the notching tool 104. In the example illustrated in FIG. 2A, the trigger mechanism 210 can extend the cutter 202 on an outer circumference of the mechanical notching tool 200 into the wellbore, the cutter 202 being configured to form a mechanical notch 208 in the wellbore, start a mud motor 206, or both. In implementations in which a dissolvable ball 214 is used, the dissolvable ball 214 is configured to dissolve in the drilling fluid after a set amount a time necessary to notch the wellbore 102. That is, the dissolvable ball 214 can dissolve until a diameter of the dissolvable ball 214 is sufficient for the ball to be dislodged from the sleeve. The cutter 202 forms mechanical notch 208 by physically contacting the wellbore 102 and removing material from the formation 112 to produce the notch. Mechanical notch 208 has a substantially "V" shaped cross section, extends several feet from the wellbore 102 into formation 112, and is circumferentially continuous around the wellbore 102. After the mechanical notch 208 has been created, the mechanical notching tool 200 is deactivated, that is, the cutter 202 is retracted. Drilling operations can then continue to the next notching point.

Figure 3B:
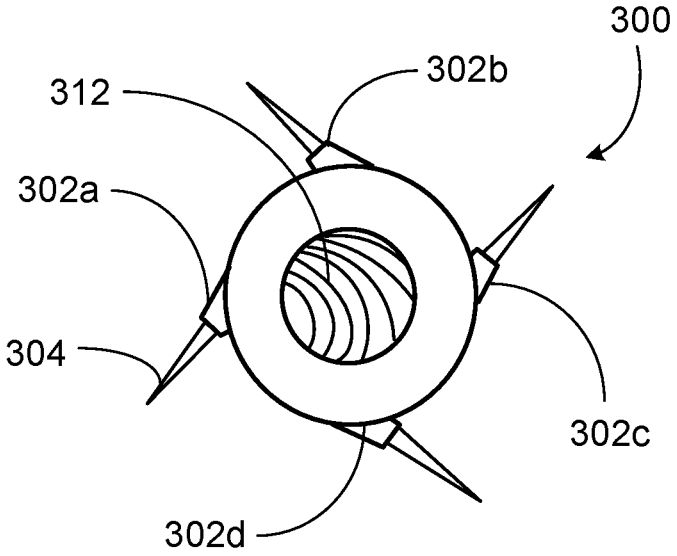
FIG. 3A-3B is a schematic diagram of an example apparatus to hydraulically notch a wellbore.
Figure 3A:
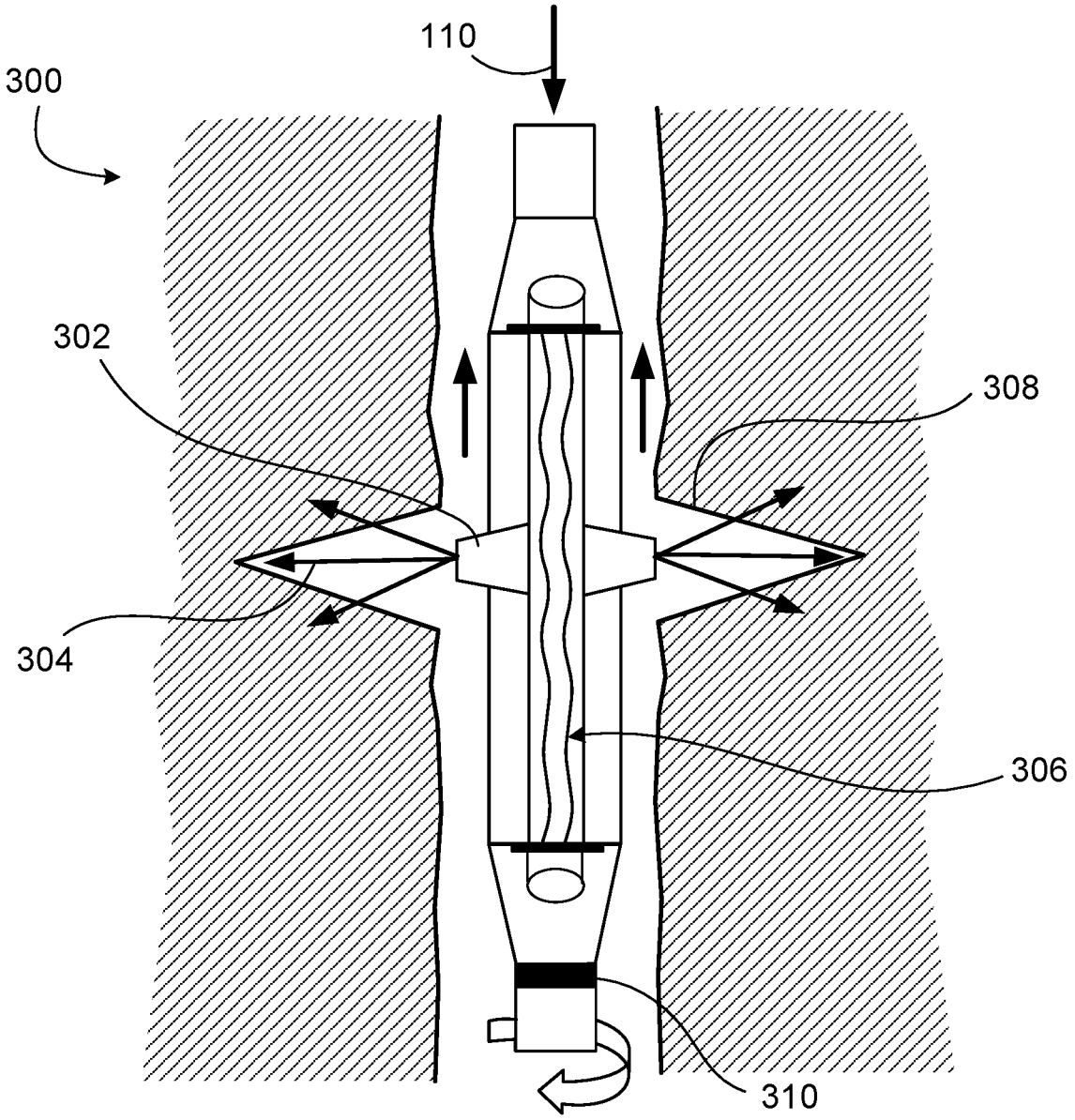

FIG. 3A shows a hydraulic jetting tool 300 that can be utilized with the DSA 100. The hydraulic jetting tool 300 can act as the notching tool 104 in some implementations. The hydraulic jetting tool 300 includes a hydraulic nozzle 302 and a trigger mechanism 310. An example shown in FIG. 3B shows four hydraulic nozzles 302 being used: a first nozzle 302*a*, a second nozzle 302*b*, a third nozzle 302*c*, and a fourth nozzle 302*d*. While the illustrated implementation may show 4 equally spaced nozzles 302, any number of equally spaced nozzles 302 may be used, such as two nozzles 302 or three nozzles 302. The nozzles 302 may be angled away from a central axis of the tool to at least partially rotate the hydraulic jetting tool 300. The hydraulic jetting tool 300 can include a mud motor 306 to spin the hydraulic jetting tool 300 separately from the drill string 108. The mud motor can be powered by drilling fluid 110 flowing through hydraulic jetting tool 300. If a mud motor 306 is not included, then the rotation of the drill string 114 may be used to rotate the hydraulic jetting tool 300. The hydraulic jetting tool 300 can be attached to the drill string 114 uphole of the drill bit 108 in some implementations when used as notching tool 104. In some implementations, the hydraulic jetting tool 300 can include internal helical grooves 312 to at least partially induce rotation in the hydraulic jetting tool 300. Hydraulic jetting tool 300 includes a trigger mechanism 310 that can be activated by several methods known in the art, such as a dropped ball/sleeve, a dissolvable ball 214, a hydraulic signal, an electrical signal, RFID, etc. The trigger mechanism 310 can direct fluid flow through hydraulic nozzle 302, start the mud motor 306, or both. In implementations where a dissolvable ball 214 is used, the dissolvable ball 214 is configured to dissolve in the drilling fluid after a set amount a time necessary to notch the wellbore 102.

In implementations utilizing the hydraulic jetting tool 300, drilling fluid flows through the drill string 114 to notching tool 104. When a designated depth has been reached, the drilling operation is paused; that is, the rate of penetration for the DSA is effectively zero. Once the drilling operations have paused, the hydraulic jetting tool 300 is activated. Once the hydraulic jetting tool 300 is activated, drilling fluid is redirected to hydraulic nozzle 302 that is located on an outer circumference of the hydraulic notching tool 300. In some implementations, an additional abrasive may be added to the drilling fluid during notching operations to improve the notching ability of the fluid jet 304. In some implementations, the drilling fluid is used as a notching fluid. The hydraulic nozzle 302 sprays notching fluid on the wellbore by creating a fluid jet 304. Fluid jet 304 is a high velocity stream of drilling fluid that is capable of removing parts of the formation immediately in the path of the fluid jet 304 forming jet notch 308. The removed parts of the formation can be removed from the wellbore when drilling and circulation operations resume. In some implementations, the fluid jet 304 is rotated by the rotation of the drill string, the rotation of the mud motor 306, the hydraulic rotation of the fluid, or a combination. In some implementations, the mud motor 306 can be integrated into the hydraulic jetting tool 300 and can also be triggered via trigger mechanism 310. Jet notch 308 has a substantially "V" shaped cross section, extends several feet from the wellbore 102 into the formation 112, and is circumferentially continuous around the wellbore 102. After the jet notch 308 has been created, the hydraulic jetting tool 300 is deactivated, that is, the drilling fluid is 110 is directed back to the drill string 114 from the hydraulic nozzle 302. Drilling operations can then continue to the next notching point.

Figure 4A:
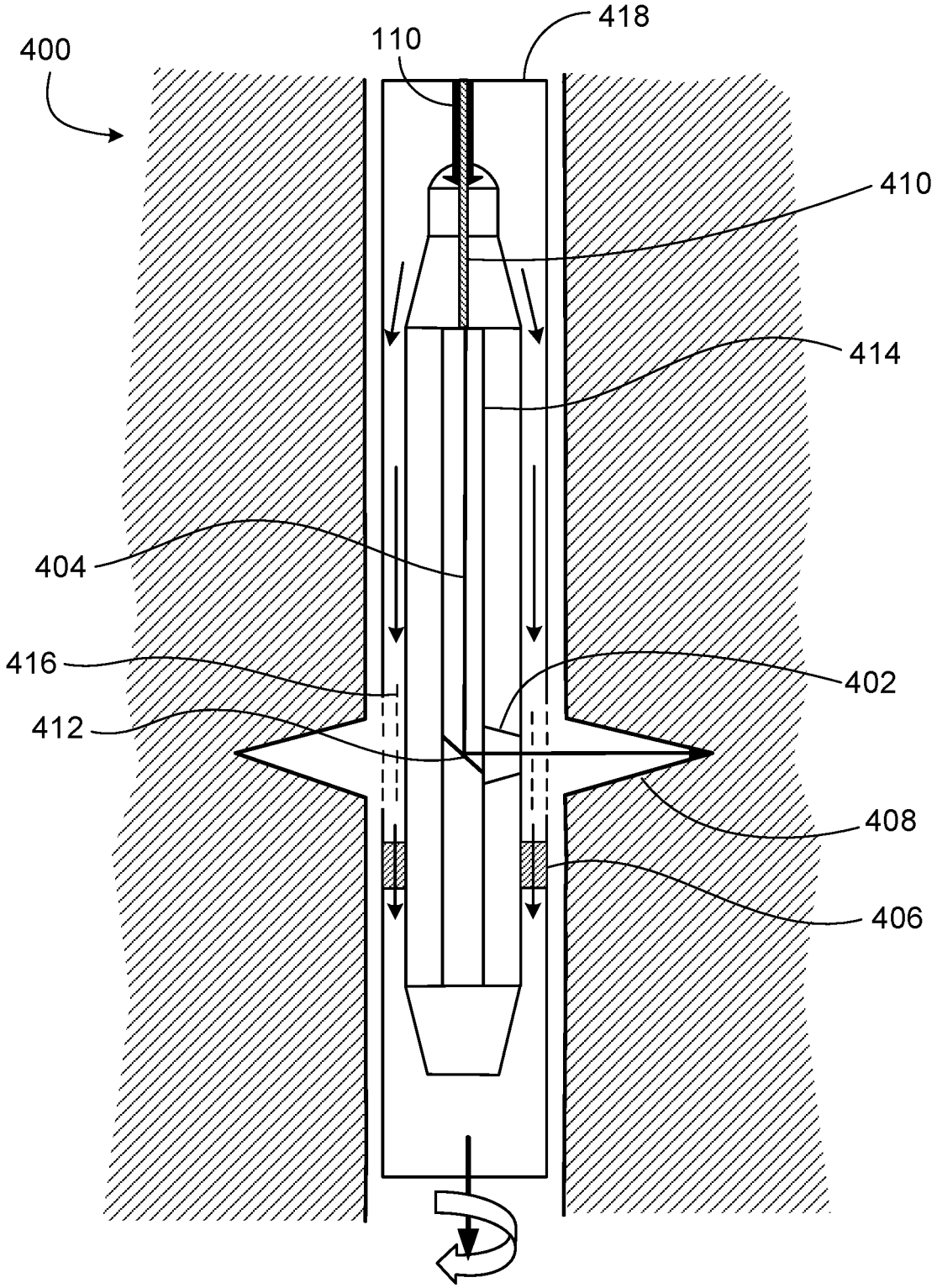
FIGS. 4A-4B are schematic diagrams of example apparatuses to notch a wellbore with a laser.

FIG. 4A shows a laser notching tool 400 that can be utilized with the DSA 100. The laser notching tool 400 includes a fiber optic cable 410, an anchor assembly 406, a directing reflector 412, a laser isolation chamber 414, and a laser outlet 402. The laser notching tool 400 can be attached within the drill string 114 uphole of the drill bit 108 in some implementations when used as notching tool 104.

In implementations utilizing the laser notching tool 400, drilling fluid flows through the drill string 114 and around notching tool 104. When a designated depth has been reached, the drilling operation is paused; that is, the rate of penetration for the DSA is effectively zero. Once the drilling operations have paused, the laser notching tool 400 is activated. Once the laser notching tool 400 is activated, a laser beam 404 is transmitted downhole in a direction substantially parallel to a longitudinal axis of the drill string 114 through a fiber optic cable 410 that is positioned within the drill string from a laser source at a topside facility. The fiber optic cable 410 is connected to an uphole end of the laser isolation chamber 414. The laser isolation chamber 414 keeps the laser beam 404, reflector 412, and other sensitive components isolated from the drilling fluid 110 within drill string 114. In some implementations, the laser beam 404 may be formed within the laser isolation chamber 414 instead of at a topside facility. The laser beam 404 is directed out of the laser outlet 402 by the reflector 412. The circulation of drilling mud can continue during laser notching operations to remove cuttings and cool the laser notching tool 400. The laser beam 404 is capable of removing parts of the formation immediately in the path of the laser beam 404 and forming a laser notch 408. The power required for any lasers used to notch a wellbore will be on the order of 1-100 kilowatts. The laser notching tool 400 is rotated by the rotation of the drill string. In some implementations, the laser notching tool 400 is actually located within the drill string 114 and is held in place by anchor assembly 406. Laser notch 408 can have a substantially "V" shaped cross section, extends several feet from the wellbore 102 into formation 112, and is circumferentially continuous around the wellbore 102. After the laser notch 408 has been created, the laser notching tool 400 is deactivated, that is, the laser beam 404 is turned off. Drilling operations can then continue to the next notching point.

Figure 4B:
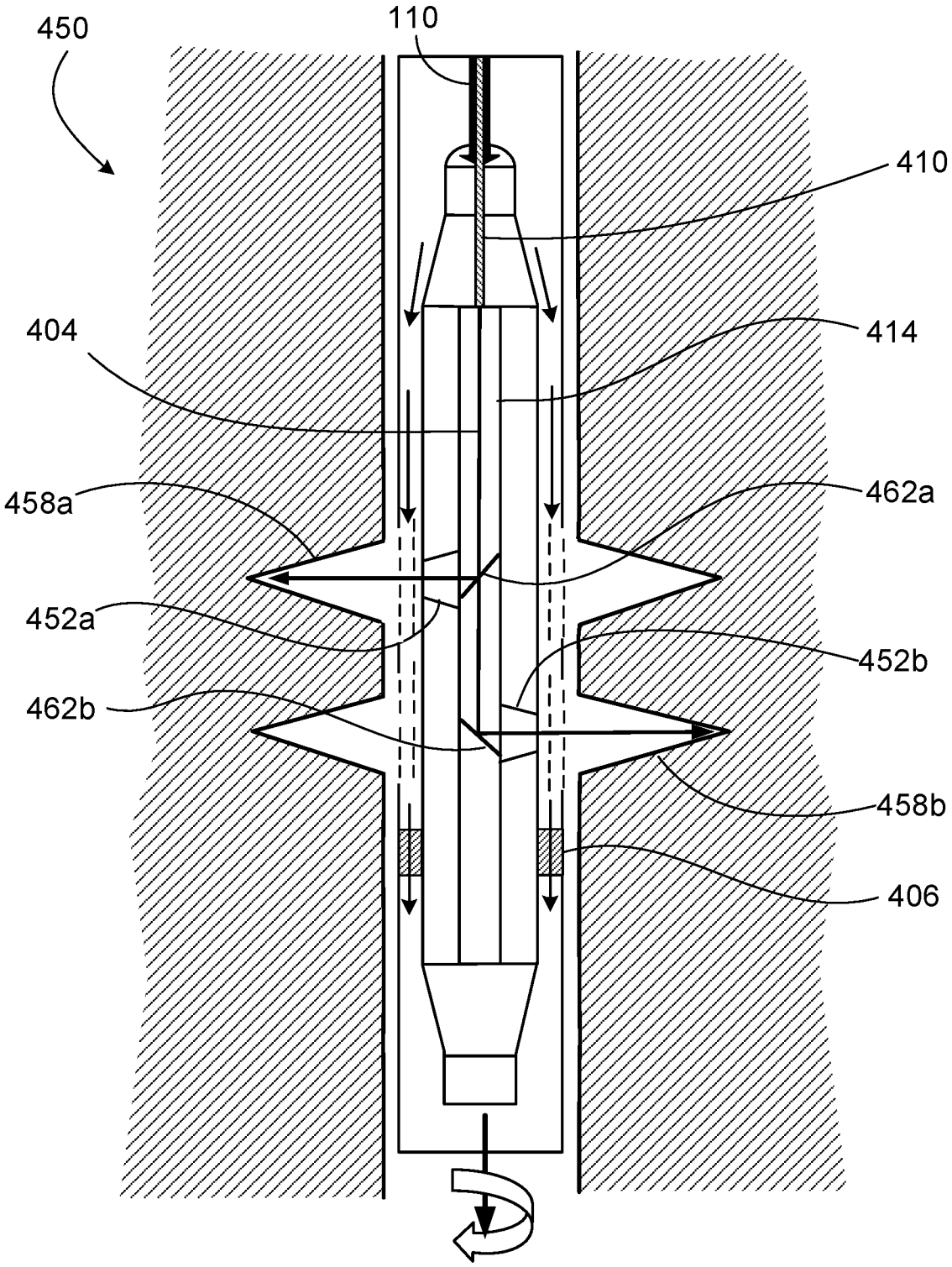

FIG. 4B shows an alternative laser notching tool 450. In this implementation, the alternative laser notching tool can create a first laser notch 458*a* at a first depth and a second laser notch 458*b* at a second depth simultaneously. A distance between the first notch 458*a* and the second notch 458*b* can range from a few inches to a few feet. While only the alternative laser notching tool 450 is shown forming multiple notches, any implementation within this disclosure can form multiple notches. Forming multiple notches is not limited to the alternative laser notching tool 450. The alternative laser notching tool 450 includes the fiber optic cable 410, laser isolation chamber 414, anchor assembly 406, a first directing reflector 462*a*, a second direction reflector 462*b*, a first laser outlet 452*a*, and a second laser outlet 452*b*. The first reflector 462*a* may be partially transparent and allow a portion of laser beam 404 through the first reflector 462*a* The second reflector 462*b* directs the remaining laser beam 404 through a second laser outlet 452*b*. Both the first laser notch 458*a* and the second laser notch 458*b* have substantially "V" shaped cross sections, extend several feet from the wellbore 102 into formation 112, and are circumferentially continuous around the wellbore 102. After the first laser notch 458*a* and the second laser notch 458*b* have been created, the laser notching tool 450 is deactivated, that is, the laser beam 404 is turned off. Drilling operations can then continue to the next notching point.

Figure 5A:
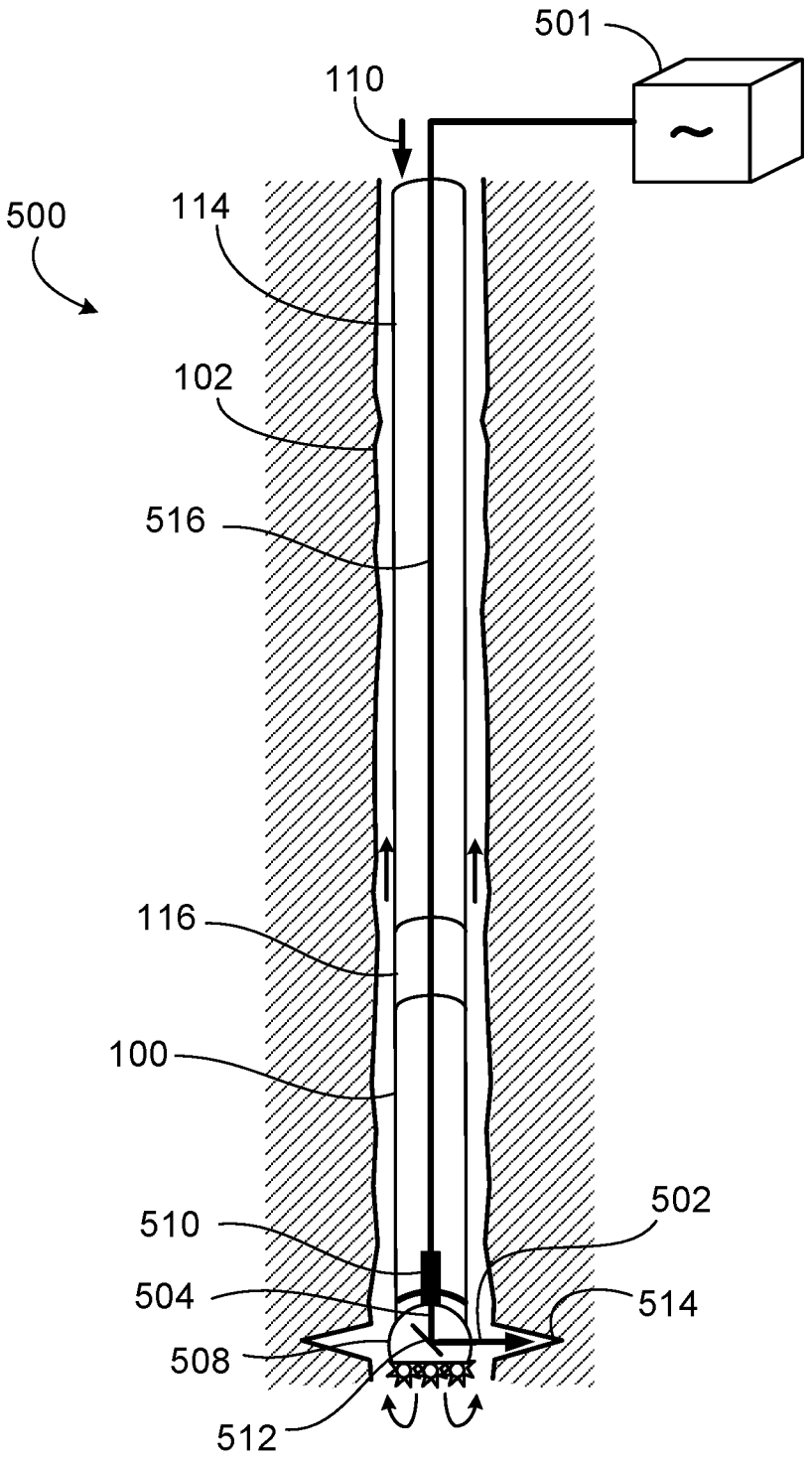
FIG. 5A-5B are schematic diagrams of an example apparatus to notch a wellbore with a laser through the drill bit.

In some implementations, a laser notching drill bit system 500 can be used. The laser notching drill bit system 500 includes a laser source 501 and a laser channel 502 to allow the laser beam 504 to exit the drill bit 508. The drill bit 508 is attached to a downhole end drill string 114 and is interchangeable with drill bit 108 discussed previously. FIG. 5A shows the laser notching drill bit system 500 in wellbore 102.

Figure 5B:
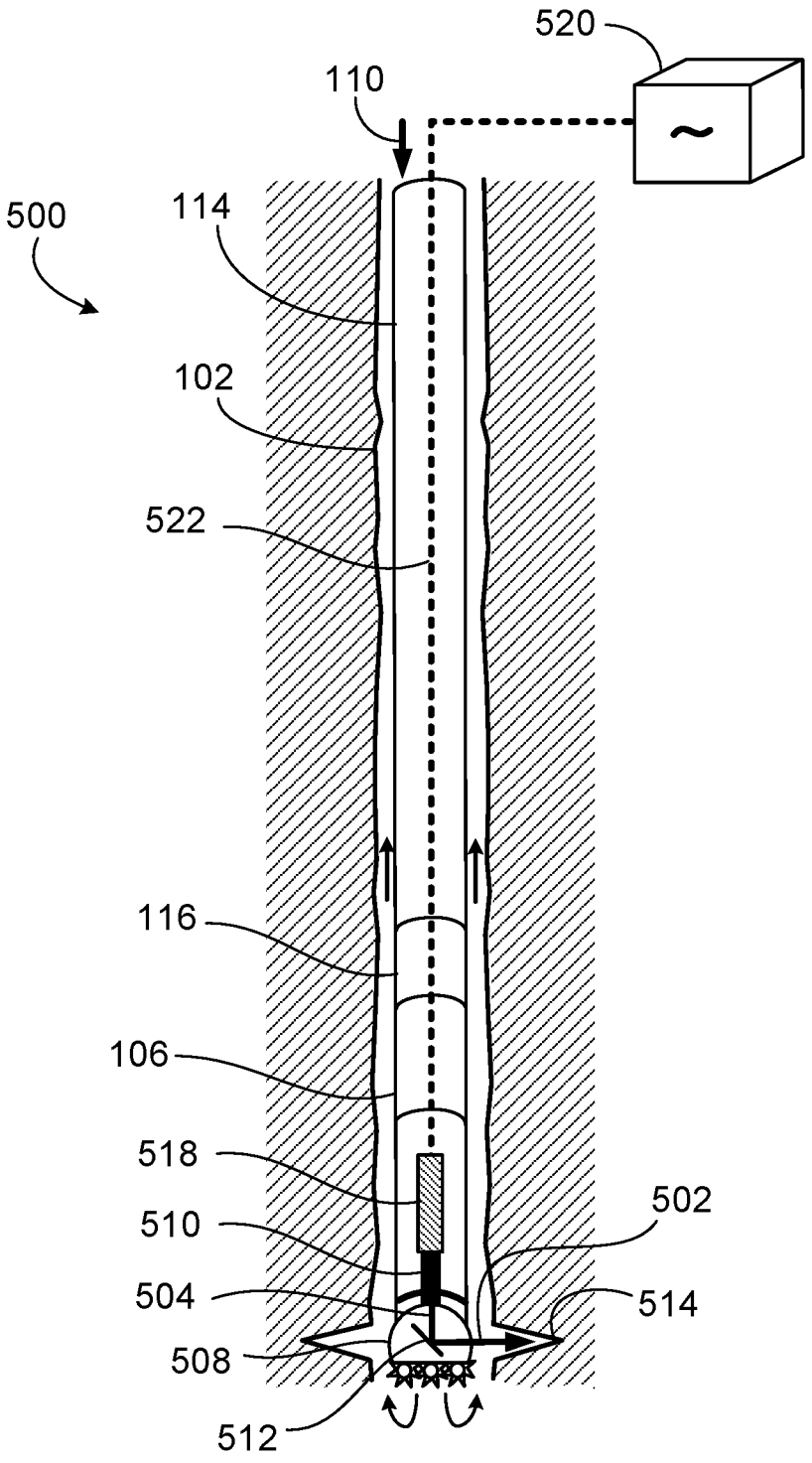

Notching tool 104 is not utilized in the implementation shown in FIGS. 5A-5B; instead, laser notching drill bit system 500 and drill bit 108 are interchanged. When a designated depth has been reached, the drilling operation is paused; that is, the rate of penetration for the DSA is effectively zero. Once the drilling operations have paused, the laser notching drill bit system 500 is activated. Once the laser notching drill bit system 500 is activated, a laser 504 is sent through laser channel 502 that passes through the drill bit 508 perpendicular to the drilling path. The laser notching drill bit system 500 is rotated by the rotation of the drill string. In some implementations, the laser 504 is formed at a topside facility 501 and directed to drill bit 508 via a fiber optic cable 516. In other implementations, laser 504 is formed near the drill bit 508, that is, laser source 518 is located within the drill string 114 near the drill bit 508 instead of at a topside facility. If laser source 518 is located near the drill bit 508, then electrical cables 522 running the entire length of drill string 114 are needed to power the laser source 518. In such an implementation, the power source 520 to power the laser source 518 is located at a topside facility. The optical components of this system are sealed from the wellbore fluids similar to the previously described laser implementations.

Figure 6:
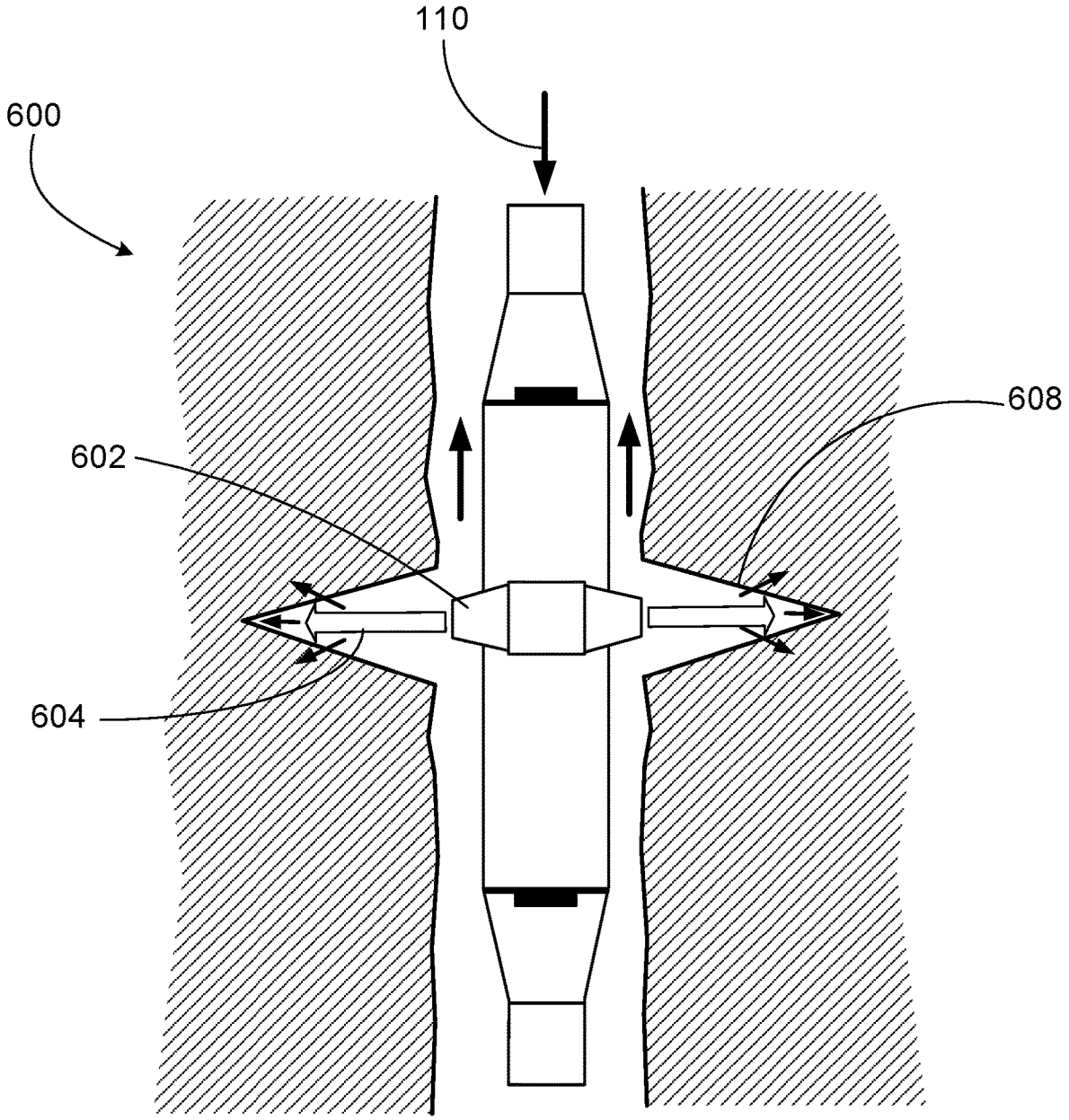
FIG. 6 is a schematic diagram of an example apparatus to thermally notch a wellbore.

FIG. 6 shows a schematic diagram of an example thermal notching tool 600. In this implementation, the thermal notching tool 600 creates a thermal notch 608 by heating the wellbore. The wellbore is effectively notched by permanently dehydrating a portion of the formation immediately adjacent to the thermal notching tool 600. Thermal energy 604 is emitted from a thermal emitter 602 with temperatures in the wellbore capable of reaching more than 1100° F. In some implementations, the thermal emitter 602 can be electrically powered. In some implementations, the thermal emitter can be powered with flammable gas. In such an implementation, flammable gas and oxygen are fed through tubing from the surface to the emitter. An electrical igniter can be used to ignite the mixture of flammable gas and oxygen. In some implementations, air can be used to supply the oxygen. In some implementations, some heat generating components can be lowered into the DSA once drilling operations have been paused for notching operations. The emitter can be small and shaped such that the thermal energy 604 is directional. That is, the thermal energy only affects a small area of the wellbore. Thermal notch 608 can have a substantially "V" shaped cross section, extends several feet from the wellbore 102 into formation 112, and is circumferentially continuous around the wellbore 102.

In implementations utilizing the thermal notching tool 600, drilling fluid 110 flows through the drill string 114. When a designated depth has been reached, the drilling operation is paused; that is, the rate of penetration for the DSA is effectively zero. Once the drilling operations have paused, the thermal notching tool 600 is activated. Once the thermal notching tool 600 is activated, the thermal emitter 602 directs focused thermal energy 604 to the surface of the wellbore 102. Fluid circulation can be stopped during thermal notching operations. Fluid can be removed from the wellbore to prevent boiling of drilling fluids during notching operations. Thermal energy 604 permanently dehydrates a portion of the formation immediately adjacent to the thermal emitter 602 effectively forming thermal notch 608. The thermal notching does not always remove material from the wellbore. The dehydrated sections can become weak points during subsequent fracturing operations. In some implementations, thermal emitter 602 can surround the entire drill string, so no rotation is needed to form thermal notch 608. Thermal notch 608 has a substantially "V" shaped cross section, extends several feet from the wellbore 102 into formation 112, and is circumferentially continuous around the wellbore 102. After the thermal notch 608 has been created, the thermal notching tool 600 is deactivated, that is, the thermal emitter 602 stops emitting the thermal energy 604. Drilling operations can then continue to the next notching point.

Figure 7:
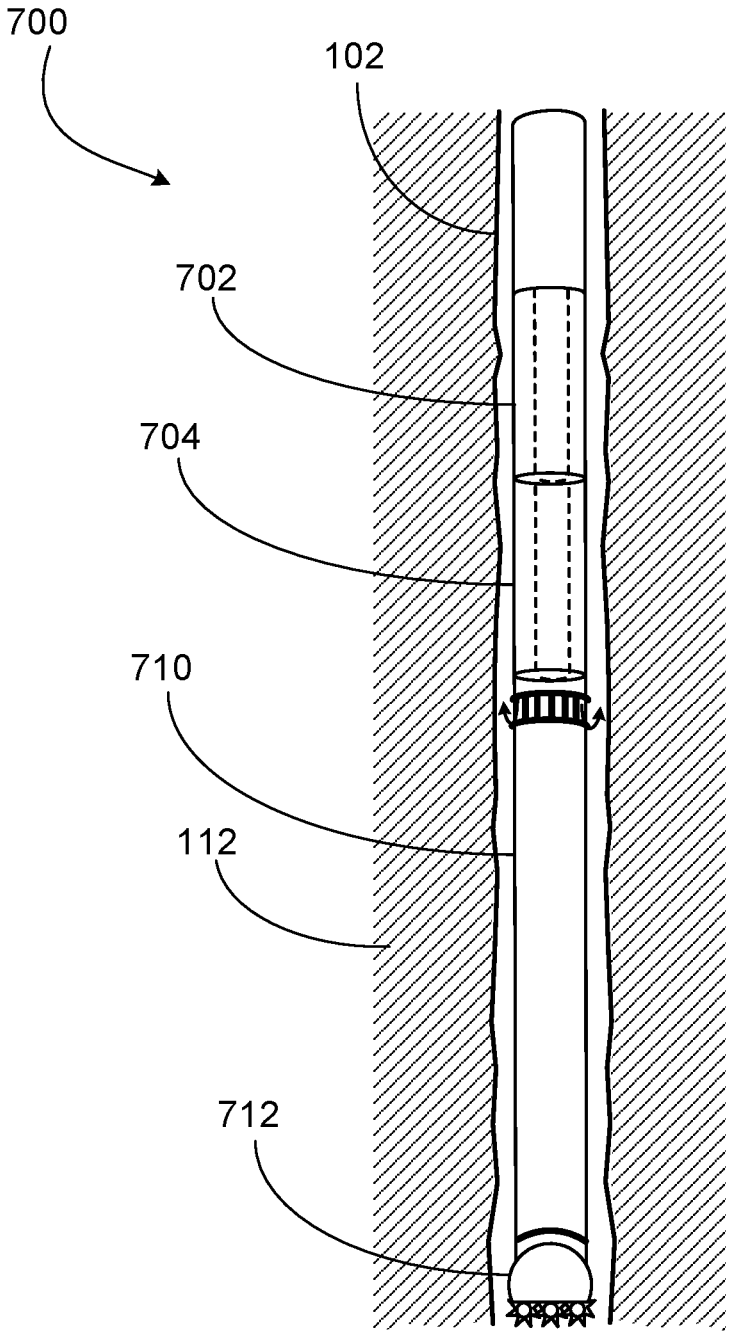
FIG. 7 is a schematic diagram of an example drill string assembly to notch a wellbore while drilling.

FIG. 7 shows an example of an alternative DSA 700 that is capable of notching wellbore 102 while drilling wellbore 102 without removing the DSA 700 from wellbore 102. The system includes a drill string 710, a first notching tool 702, a second notching tool 704, and a drill bit 712. The drill bit 712 is attached to the downhole end of drill string 710. The alternative DSA 700 is capable of mixing and matching any of the previously mentioned implementations; for example, the first notching tool 702 may be mechanical notching tool

200 while the second notching tool 704 may be the hydraulic jetting tool 300. Other combinations can include any of the laser implementations in combination with the thermal notching tool 600, the hydraulic jetting tool in combination with the thermal notching tool 600, the hydraulic jetting tool 300 in combination with the thermal nothing tool 600, and any other combinations.

Figure 8:
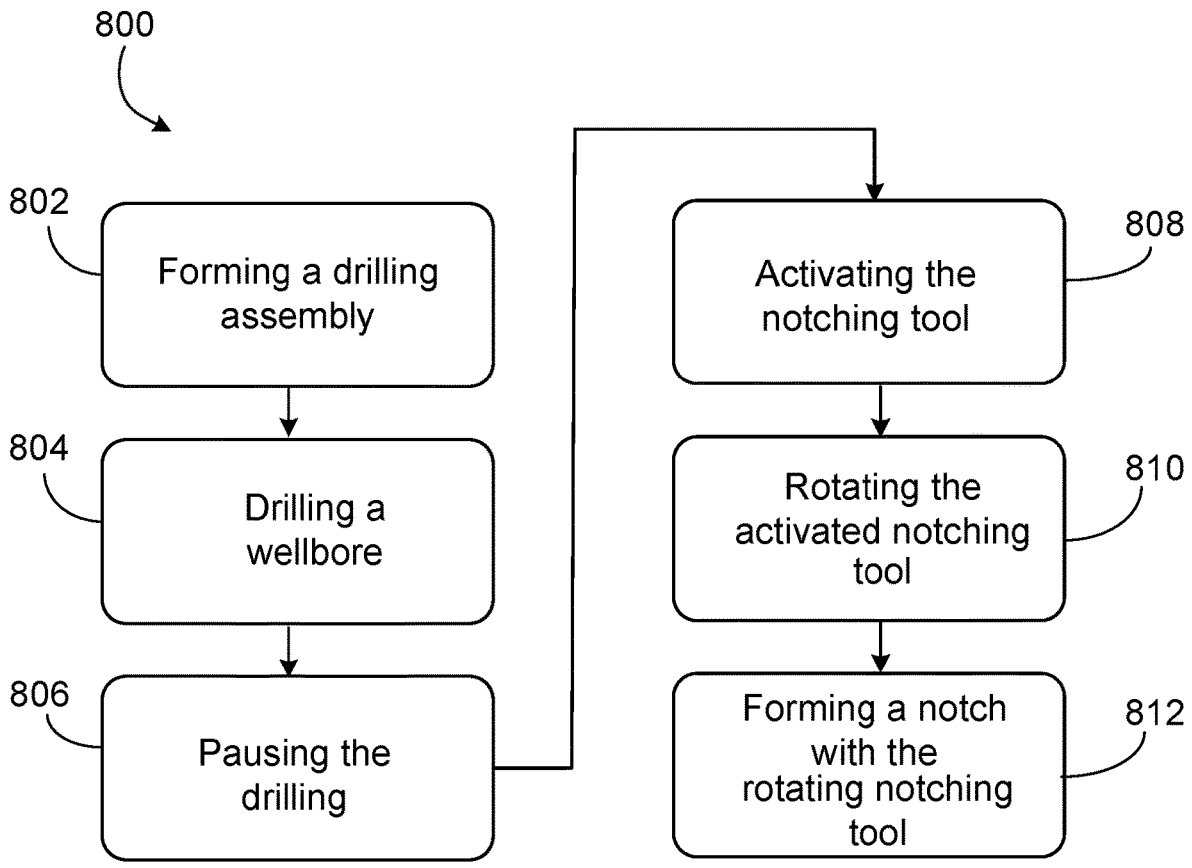
FIG. 8 is a flowchart showing an example method for utilizing a drill string assembly to notch while drilling.

FIG. 8 shows a flow chart with an example method 800 for utilizing a DSA, such as DSA 100 or alternative DSA 500. At 802, a drill string assembly, such as DSA 100 or alternative DSA 500, is assembled. At 804, a wellbore is drilled. At 806, the drilling is paused. At 808, a notching tool is activated. At 810, the activated notching tool is rotated. At 812 a notch is formed with the rotating notching tool. After the notch is formed, the notching tool is deactivated and drilling operations continue.

Thus, particular implementations of the subject matter have been described. Other implementations are within the scope of the following claims.

The invention claimed is:

1. A method comprising:

drilling a wellbore in a formation using a drill string assembly comprising: a drill string, a drill bit connected to a downhole end of the drill string, and a notching tool connected to the drill string, the notching tool configured to form a V-shaped notch, wherein the notching tool comprises a mechanical notching tool;

after drilling the wellbore to a depth from a surface in the formation, pausing the drilling;

activating the mechanical notching tool, wherein activating the mechanical notching tool comprises dropping a dissolvable ball into the drill string, the dissolvable ball configured to be dissolved by a drilling fluid, the dissolvable ball received by the notching tool, wherein a hydraulic power is diverted from the drill bit to the mechanical notching tool in response to the notching tool receiving the dissolvable ball, and wherein the drilling fluid flows out of the notching tool into the wellbore via a hydraulic vent after passing through the notching tool; and forming a continuous V-shaped notch around a circumference of the wellbore solely with the activated mechanical notching tool, wherein the V-shaped notch provides a stress concentration factor, wherein the drill string assembly remains within the wellbore throughout the drilling and forming the continuous V-shaped notch, and wherein forming the V-shaped notch comprises activating the mechanical notching tool to extend cutters on an outer circumference of the mechanical notching tool into the wellbore, the cutters configured to form the V-shaped notch in the wellbore.

2. The method of claim 1, wherein forming the V-shaped notch with the activated notching tool comprises rotating the notching tool to form the V-shaped notch.

3. The method of claim 2, further comprising:

de-activating the notching tool after forming the V-shaped notch; and continuing drilling the wellbore in the formation.

4. The method of claim 3, wherein the V-shaped notch is a first V-shaped notch, wherein the wellbore is drilled to a second depth from the surface, and wherein the method further comprises:

after drilling the wellbore to the second depth from the surface, pausing the drilling;

activating the notching tool; and forming a second continuous V-shaped notch around the circumference of the wellbore at the second depth with the activated notching tool, wherein the drill string assembly remains within the wellbore throughout the drilling and forming the second continuous V-shaped notch.

5. The method of claim 1, wherein the V-shaped notch is formed at a notching depth from the surface, and wherein the V-shaped notch surrounds the drill string at the notching depth.

6. The method of claim 1, wherein the notching tool is disengaged from the wellbore during drilling the wellbore to the depth, and wherein the notching tool is engaged to the wellbore after pausing the drilling.

* * * * *